US009681782B2

(12) United States Patent
McCauley

(10) Patent No.: US 9,681,782 B2
(45) Date of Patent: Jun. 20, 2017

(54) EXTENDABLE BATTERY OPERATED SCRUBBER BRUSH WITH INTERCHANGEABLE ROTATING BRUSH HEADS

(71) Applicant: Pamela R. McCauley, Bronx, NY (US)

(72) Inventor: Pamela R. McCauley, Bronx, NY (US)

( * ) Notice: Subject to any disclaimer, the term of this patent is extended or adjusted under 35 U.S.C. 154(b) by 0 days.

(21) Appl. No.: 15/299,650

(22) Filed: Oct. 21, 2016

(65) Prior Publication Data

US 2017/0112333 A1 Apr. 27, 2017

Related U.S. Application Data

(60) Provisional application No. 62/244,482, filed on Oct. 21, 2015.

(51) Int. Cl.

| | |
|---|---|
| ***A46B 5/00*** | (2006.01) |
| ***A46B 13/02*** | (2006.01) |
| ***A47K 7/04*** | (2006.01) |
| ***A46B 13/00*** | (2006.01) |
| ***A46B 13/08*** | (2006.01) |

(52) U.S. Cl.

CPC ..... *A47K 7/043* (2013.01); *A46B 5/0095* (2013.01); *A46B 13/008* (2013.01); *A46B 13/02* (2013.01); *A46B 13/08* (2013.01)

(58) Field of Classification Search

CPC ..... A46B 13/008; A46B 13/02; A46B 5/0095; A47K 7/043

See application file for complete search history.

(56) References Cited

U.S. PATENT DOCUMENTS

| | | | | |
|---|---|---|---|---|
| 4,202,068 | A * | 5/1980 | Lester | A46B 5/005 15/144.4 |
| 5,495,632 | A | 3/1996 | Baker | |
| 5,500,972 | A | 3/1996 | Foster | |
| 5,511,269 | A * | 4/1996 | Watson | A46B 5/0033 15/144.4 |
| 6,170,108 | B1 | 1/2001 | Knight | |
| 7,152,266 | B1 * | 12/2006 | Haughton | A46B 5/0033 15/28 |
| 7,331,077 | B1 * | 2/2008 | Henry | A46B 5/0033 15/23 |
| 8,713,739 | B1 | 5/2014 | Alas et al. | |

(Continued)

*Primary Examiner* — Randall Chin

(74) *Attorney, Agent, or Firm* — Global Intellectual Property Agency, LLC; Daniel Boudwin

(57) ABSTRACT

An extendable battery operated scrubber brush with interchangeable brush heads is provided. The scrubber brush includes a battery operated scrubber brush having an extendable handle and a plurality of interchangeable brush heads, each having different body cleaning materials thereon, and a battery charging docking station. The handle is extendable via an elongated member that is slidably disposed in an interior volume thereof. The handle includes a proximal end and a distal end that includes a drive shaft for removably receiving an interchangeable brush head thereon. The drive shaft is coupled to an electric motor disposed in the handle that rotates the drive shaft and drives an interchangeable brush head mounted thereon. The proximal end includes a port for receiving an electrical connector disposed in the docking station and one or more activation switches for activating the electric motor and driving the drive shaft.

10 Claims, 3 Drawing Sheets

(56) References Cited

U.S. PATENT DOCUMENTS

| | | | | |
|---|---|---|---|---|
| 2003/0213078 | A1* | 11/2003 | Kristofek | A01K 63/10 15/97.1 |
| 2004/0083567 | A1* | 5/2004 | Lies | A47L 11/162 15/28 |
| 2009/0188528 | A1 | 7/2009 | Junkins | |
| 2014/0099154 | A1 | 4/2014 | O'Neill | |

* cited by examiner

EXTENDABLE BATTERY OPERATED SCRUBBER BRUSH WITH INTERCHANGEABLE ROTATING BRUSH HEADS

CROSS REFERENCE TO RELATED APPLICATIONS

This application claims the benefit of U.S. Provisional Application No. 62/244,482 filed on Oct. 21, 2015. The above identified patent application is herein incorporated by reference in its entirety to provide continuity of disclosure.

BACKGROUND OF THE INVENTION

The present invention relates to battery operated bath brushes. More specifically, the present invention relates to an extendable battery operated scrubber brush having interchangeable rotating brush heads and a docking station for recharging the battery.

The use of battery operated bath brushes is known in the prior art. More specifically, battery operated bath brushes heretofore devised and utilized are known to consist basically of familiar, expected and obvious structural configurations, notwithstanding the myriad of designs encompassed by the crowded prior art which have been developed for the fulfillment of countless objectives and requirements.

While these devices fulfill their respective, particular objectives and requirements, the aforementioned patents do not disclose an extendable battery operated scrubber brush including interchangeable rotating brush heads and a docking station for recharging the battery.

In these respects, the battery operated scrubber brush according to the present invention substantially departs from the conventional concepts and designs of the prior art, and in so doing provides an apparatus primarily developed for the purpose of providing a scrubber brush capable of extending to reach the hard to reach areas of a user's body and including interchangeable brush heads having different body cleaning materials.

SUMMARY OF THE INVENTION

In view of the foregoing disadvantages inherent in the known types of battery operated bath brushes now present in the prior art, the present invention provides an extendable battery operated scrubber brush with interchangeable rotating brush heads wherein the same can be utilized for providing convenience for the user when bathing. The present invention comprises a scrubber brush including an extendable handle having a distal end coupled to a proximal end in a closed position and an elongated member slidably disposed in an interior of the handle, wherein the distal end and proximal end are extendable along the elongated member, and wherein the distal end is configured to disengage from the proximal end to enable extension about the elongated member and move the handle from the closed position to an open position. Further, the scrubber brush includes a recessed opening disposed on the distal end, a drive shaft centrally disposed on a base of the recessed opening, a motor disposed in the handle, wherein the motor configured to rotate the drive shaft, and a plurality of interchangeable brush heads, wherein the plurality of brush heads comprising a planar member including a lower side having a channel sized to receive the drive shaft and an upper side having an arrangement of body cleaning materials, wherein the plurality of brush heads comprises at least, a brush head, wherein the upper side includes a sponge, a brush head, wherein the upper side includes a first arrangement of a plurality of bristles, a brush head, wherein the upper side includes a second arrangement of a plurality of bristles, and a brush head, wherein the upper side includes a third arrangement of a plurality of bristles, wherein the recessed opening is sized to receive one of the plurality of interchangeable brush heads flush therein, and wherein the drive shaft is configured to rotate one of the plurality of interchangeable brush heads mounted thereon.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
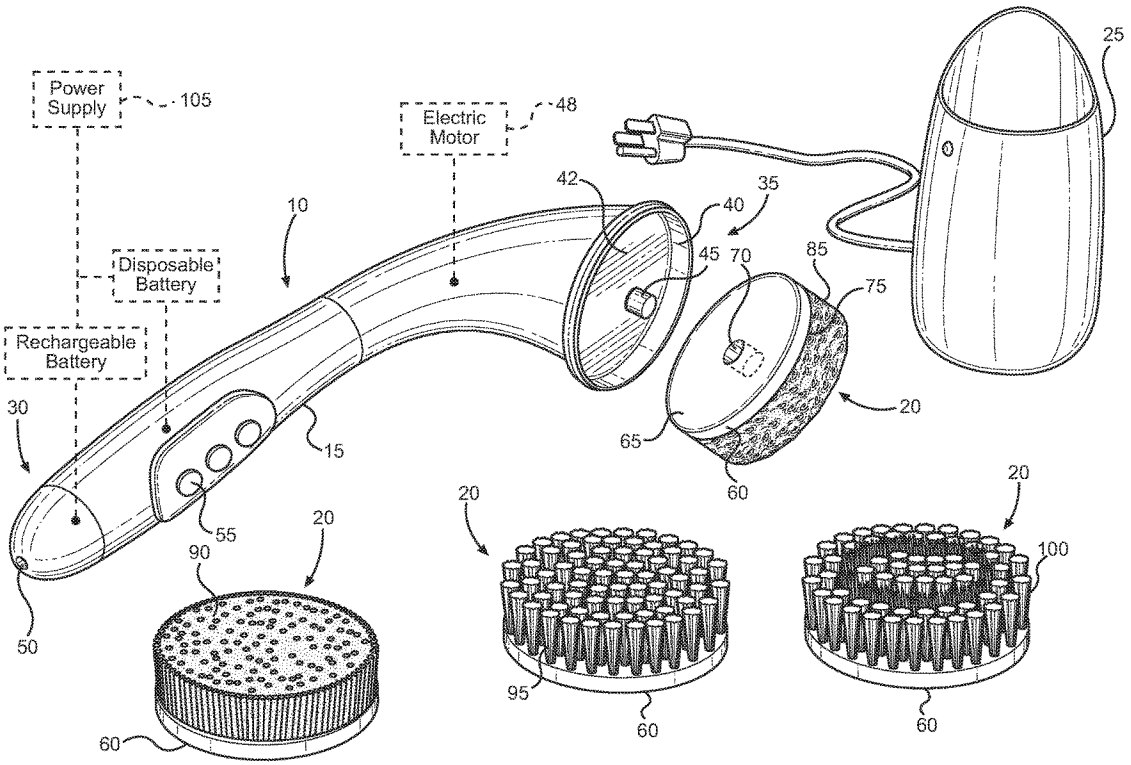
FIG. 1 shows a perspective view of the scrubber brush, the docking station, and the interchangeable brush heads.

Reference is made herein to the attached drawings. Like reference numerals are used throughout the drawings to depict like or similar elements of the battery operated scrubber brush. The figures are intended for representative purposes only and should not be considered to be limiting in any respect.

Figure 3:
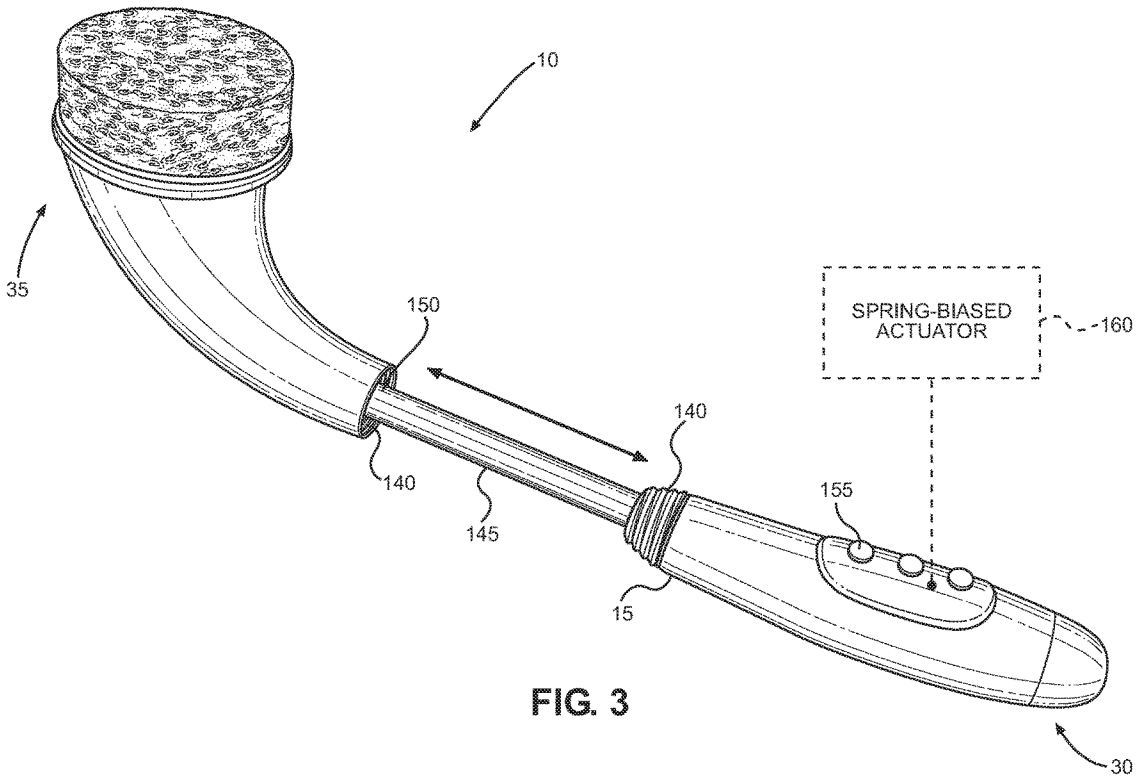
FIG. 3 shows a perspective view of handle of the scrubber brush in an extended position.

Referring now to FIG. 1, there is shown a perspective view of the scrubber brush, the docking station, and the interchangeable brush heads of the present invention. The present invention comprises a battery operated scrubber brush 10 having an extendable waterproof handle 15 and a plurality of interchangeable brush heads 20, and a battery charging docking station 25. The handle 15 is extendable via an elongated member, as shown in FIG. 3, slidably disposed in an interior volume thereof. The handle 15 is constructed of water resistant material, such as plastic, and is configured to prevent water from breaching its interior volume and thereby damaging its electronic components. The handle 15 includes a proximal end 30 and a distal end 35, wherein the distal end 35 includes a recessed opening 40 and a drive shaft 45 configured to removably receive the interchangeable brush heads 20. The handle 15 includes an ergonomic shape having a round cross-section for comfortable gripping. Further, the distal end 35 of the handle 15 is curved and increases in cross-sectional area towards the recessed opening 40. In these ways, users may grasp the proximal end 30 of the handle 15 and angle the distal end 35 towards various body parts for cleaning with an interchangeable brush head 20 mounted thereon without having to strain their wrist.

The drive shaft 45 is coupled to an electric motor 48 disposed in the scrubber brush that rotates the drive shaft 45 and drives an interchangeable brush head 20 mounted thereon. The proximal end 30 includes a port 50 for receiving an electrical connector (not shown) disposed in the docking station 25 and one or more activation switches 55 for activating the electric motor 48 and driving the drive shaft 45.

The recessed opening 40 includes a base 42 wherein the drive shaft 45 is centrally disposed thereon. The recessed opening 40 is sized to receive either of the plurality of interchangeable brush heads 20 flush therein. Each of the plurality of interchangeable brush heads 20 includes a planar member 60 configured rest flush within the recessed opening 40. In the depicted embodiment, the planar member 60 is circular in shape. However, in alternative embodiments, the planar member 60 may comprise any variety of shapes configured to rest flush within the recessed opening 40. The planar member 60 includes a lower side 65 having a channel 70 thereon sized to receive the drive shaft 45 therein and an upper side 75 having an arrangement of body cleaning materials. For example, in the depicted embodiment, the scrubber brush 10 includes an interchangeable brush head 20 having a sponge 85, an interchangeable brush head 20 having a first arrangement of a plurality of bristles 90, an interchangeable brush head 20 having a second arrangement of a plurality of bristles 95, and an interchangeable brush head 20 having a third arrangement of a plurality of bristles 100. In this way, a user can detachably mount a brush head 20 having a different arrangement of body cleaning materials to the scrubber brush 10 as desired.

The drive shaft 45 protrudes upwardly and perpendicularly relative to the base of the recessed opening 40. The drive shaft 45 is operably coupled to the electric motor 48 of the scrubber brush 10. The electric motor 48 is disposed in the handle 15 and is operably coupled to a power supply 105 of the scrubber brush 10. Once the scrubber brush 10 is activated, the electric motor 48 rotates the drive shaft 45, which in turn rotates the interchangeable brush head mounted 20 thereon. The one or more activation switches 55 are disposed on the proximal end 30 of the handle 15 and adjust the speed at which the electric motor 48 rotates the drive shaft 45. In this way, a user may adjust the speed at which the electric motor 48 rotates the interchangeable heads rotate as desired. In the depicted embodiment, the scrubber brush 10 comprises a pair of activation switches, wherein one activation switch is for activating the scrubber brush 10 and one activation switch is for adjusting the speed of the drive shaft 45. However, in alternative embodiments, the scrubber brush 10 may comprise one activation switch for activating the scrubber brush 10 and controlling the speed of the drive shaft 45 or more than two activation switches for powering the device on and off, adjusting the speed of the drive shaft 45, extending the handle 15.

The power supply 105 of the scrubber device 10 is disposed in the proximal end 30 of the handle 15 and includes both a rechargeable battery and a disposable battery. The rechargeable battery is operably coupled to the port 50 which is disposed on the tip of the proximal end 30. The rechargeable battery is fixedly mounted into the handle 15 while the disposable battery is accessible via a removable portion 110 which includes a threaded engagement. In this way, a user may recharge the rechargeable battery using the docking station 25 or travel without the docking station 25 and power the scrubber device 10 simply by utilizing disposable batteries and replacing them as needed.

Figure 2:
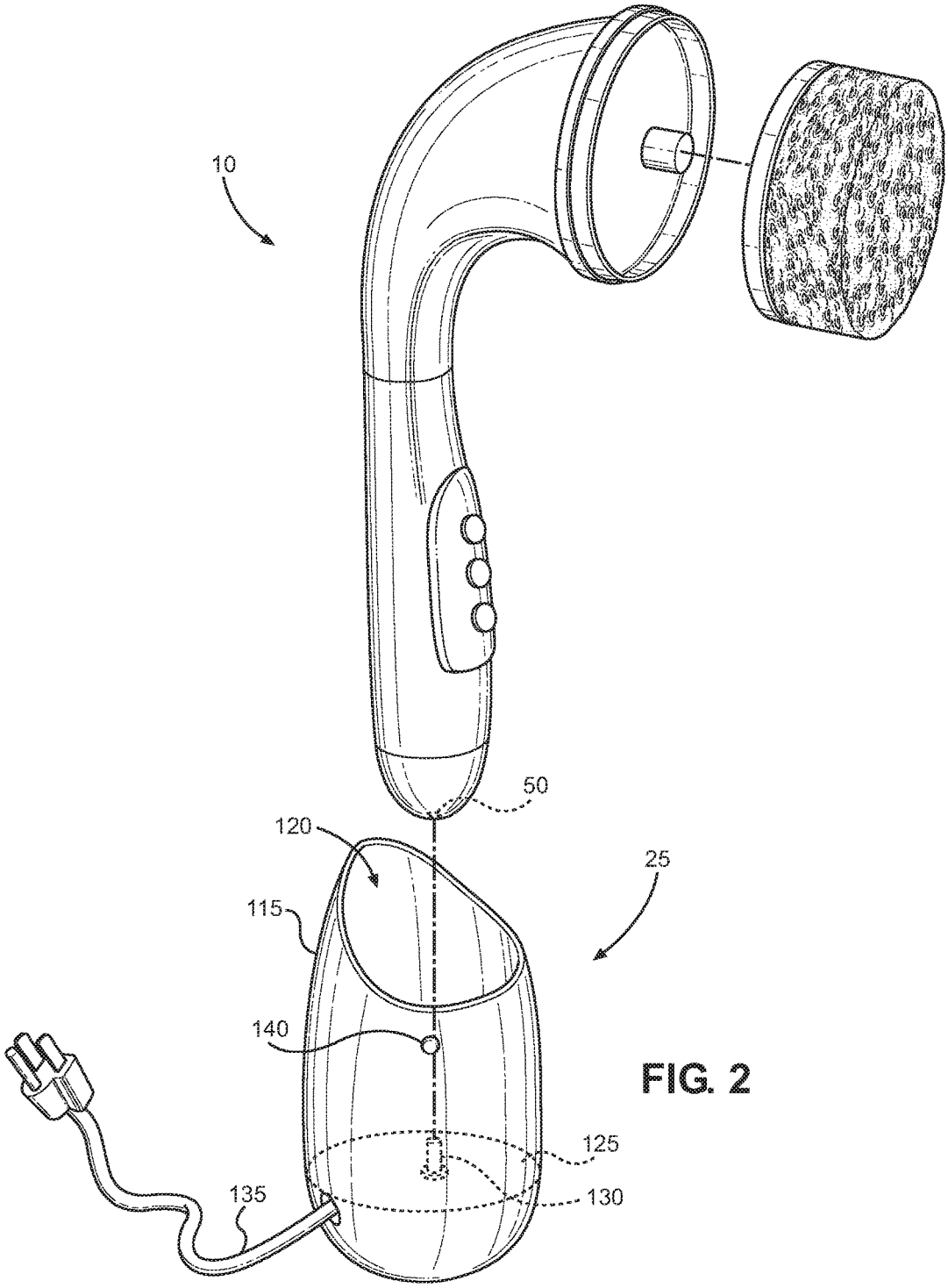
FIG. 2 shows an exploded view of the brush head being mounted onto the drive shaft and the handle being mounted onto the docking station.

Referring now to FIG. 2 there is shown an exploded view of the brush head being mounted onto the drive shaft and the handle being mounted onto the docking station. The docking station 25 is configured to charge the rechargeable battery of the power supply 105. The docking station 25 comprises an upstanding housing 115 having an open upper end 120 providing access to an interior volume thereof. The interior volume of the housing 115 includes a base 125 comprising an electrical connector 130 and a power plug 135 operably coupled to the electrical connector 130. The power plug 135 is configured to connect to an electrical socket of a structure to supply power to the docking station 25. The port 50 of the scrubber brush 10 is configured to plug into the electrical connector 130 to receive power therefrom. When the port 50 is connected to the electrical connector 130 a light source 140 disposed on an exterior of the housing 115 illuminates, thereby indicating that the scrubber brush 10 is charging.

Referring now to FIG. 3, there is shown a perspective view of the handle of the scrubber brush in an extended position. The proximal end 30 and the distal end 35 of the handle 15 include threaded engagements 140 for threadably engaging and disengaging the handle 15 into a closed and extended position to provide access to the elongated member 145. The elongated member 145 is slidably disposed in an interior volume of the proximal end 30 of the handle 15. The elongated member 145 includes a distal end 150 attached to the distal end 35 of the handle 15, such that when the ends 30, 35 are threadably disengaged the elongated member 145 extends with the distal end 35 of the handle 15. In the depicted embodiment, the elongated member 145 is a straight tubular member having a smaller cross sectional area than the handle 15.

When extending the length of the scrubber brush 10 a user threadably disengages the ends 30, 35 and pulls the ends 30, 35 away from each other. The elongated member 145 then slides longitudinally, outwardly from the proximal end 30 of the handle 15, thereby moving the handle 15 into an open position and extending the length of the scrubber brush 10. When shortening the length of the scrubber brush 10 a user slides the elongated member 145 longitudinally, inwardly back towards and into the interior volume of the proximal end 30, thereby moving the handle 15 into a closed position and shortening the length of the scrubber brush 10. When the elongated member 145 is slid back into the proximal end 30, a user then threadably engages the ends 30, 35 via their threaded engagements 140 to fasten the scrubber brush 10 in its closed position.

In another embodiment, the elongated member 145 is slidably disposed in an interior volume of the distal end 35 of the handle 15 and includes a proximal end attached to the proximal end 30 of the handle 15, such that when the ends 30, 35 are threadably disengaged, the elongated member 145 extends with the proximal end 30 of the handle 15. Thus, when moving the handle 15 into an open position and extending the length of the scrubber brush 10, the elongated member 145 slides longitudinally, outwardly from the distal end 30 of the handle 15.

In an alternative embodiment, the scrubber brush 10 includes a handle extension switch 155 operably coupled to a spring-biased actuator 160 that when depressed, ejects the elongated member 145 from the interior volume of the proximal end 30 of the handle 15, thereby sliding the elongated member 145 longitudinally, outwardly from the proximal end 30 and extending the scrubber brush 10 into the open position. The spring-biased actuator 160 is disposed in the proximal end 30 and biased towards the distal end 35 of the handle. When shortening the length of the scrubber brush 10, the elongated member 145 is slid back into the interior volume of the proximal end 30, which compresses the spring biased actuator 160 in position for ejection.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scrubber brush, comprising:

an extendable handle including a distal end coupled to a proximal end in a closed position;

an elongated member slidably disposed in an interior of the handle, the distal end and proximal end extendable along the elongated member;

wherein the distal end is configured to disengage from the proximal end to enable extension about the elongated member and move the handle from the closed position to an open position;

a recessed opening disposed on the distal end;

a drive shaft centrally disposed on a base of the recessed opening;

a motor disposed in the handle, the motor configured to rotate the drive shaft;

a plurality of interchangeable brush heads, the plurality of brush heads comprising a planar member including a lower side having a channel sized to receive the drive shaft and an upper side having an arrangement of body cleaning materials, wherein the plurality of brush heads comprises at least;

a brush head, wherein the upper side includes a sponge;

a brush head, wherein the upper side includes a first arrangement of a plurality of bristles;

a brush head, wherein the upper side includes a second arrangement of a plurality of bristles; and a brush head, wherein the upper side includes a third arrangement of a plurality of bristles;

wherein the recessed opening is sized to receive one of the plurality of interchangeable brush heads flush therein;

wherein the drive shaft is configured to rotate one of the plurality of interchangeable brush heads mounted thereon.

2. The scrubber brush of claim 1, further comprising;

a power supply operably coupled to the motor;

one or more activation switches coupled to the power supply;

a port disposed on a tip of the proximal end, the port being operably coupled to the power supply of the scrubber brush; and a docking station including a power plug for providing power thereto and a housing having an open upper end and an interior volume sized to receive the handle, the interior volume including a base having an electrical connector configured to receive and connect to the port;

wherein the docking station charges the power supply, when the port is connected to the electrical connector.

3. The scrubber brush of claim 2, wherein the docking station further comprises a light source disposed on an exterior surface thereof, wherein the light source is configured to illuminate when the port is connected to the electrical connector.

4. The scrubber brush of claim 2, wherein the power supply comprises a rechargeable battery fixedly mounted onto the handle, wherein the rechargeable battery is electrically coupled to the port.

5. The scrubber brush of claim 2, wherein the power supply comprises a disposable battery accessible via a removable portion disposed on the proximal end of the handle.

6. The scrubber brush of claim 1, wherein the one or more activation switches comprises an on/off switch for activating the power supply and a brush head speed adjustment switch for adjusting the speed at which the electric motor rotates the drive shaft and drives the brush head.

7. The scrubber brush of claim 6, wherein the one or more activation switches further comprises a handle extension switch operably coupled to a spring-biased actuator that is configured to eject the elongated member from the interior of the handle upon actuation of the switch.

8. The scrubber brush of claim 1, wherein the elongated member is slidably attached to an interior of the proximal end and fixedly attached to the distal end, wherein the distal end is configured to threadably disengage from the proximal end to enable extension of the elongated member from the proximal end and move the handle from the closed position to an open position.

9. The scrubber brush of claim 1, wherein the elongated member is slidably attached to an interior of the distal end and fixedly attached to the proximal end, wherein the distal end is configured to threadably disengage from the proximal end to enable extension of the elongated member from the distal end and move the handle from the closed position to an open position.

10. The scrubber brush of claim 1, wherein the distal end of the handle is curved and increases in cross-sectional area towards the recessed opening.

* * * * *